United States Patent [19]

Keefer

[11] Patent Number: 4,814,568

[45] Date of Patent: Mar. 21, 1989

[54] CONTAINER FOR MICROWAVE HEATING INCLUDING MEANS FOR MODIFYING MICROWAVE HEATING DISTRIBUTION, AND METHOD OF USING SAME

[75] Inventor: Richard M. Keefer, Peterborough, Canada

[73] Assignee: Alcan International Limited, Montreal, Canada

[21] Appl. No.: 51,078

[22] Filed: May 15, 1987

[51] Int. Cl.[4] ..... H05B 6/80

[52] U.S. Cl. ..... 219/10.55 E; 219/10.55 F; 219/10.55 M; 426/107; 426/243; 99/DIG. 14

[58] Field of Search ..... 219/10.55 E, 10.55 F, 219/10.55 M, 10.55 R, 10.55 D; 426/241, 243, 234, 107; 99/DIG. 14, 451; 126/390

[56] References Cited

U.S. PATENT DOCUMENTS

| | | | |
|---|---|---|---|
| 3,219,460 | 11/1965 | Brown | 219/10.55 E |
| 3,946,187 | 3/1976 | MacMaster et al. | 219/10.55 E |
| 3,946,188 | 3/1976 | Derby | 219/10.55 E |
| 4,230,924 | 10/1980 | Brastad et al. | 219/10.55 E |
| 4,268,738 | 5/1981 | Flautt, Jr. et al. | 219/10.55 F |
| 4,398,077 | 8/1983 | Freedman et al. | 219/10.55 E |
| 4,416,907 | 11/1983 | Watkins | 426/234 |

*Primary Examiner*—Philip H. Leung

*Attorney, Agent, or Firm*—Cooper & Dunham

[57] ABSTRACT

A container for holding a body of material to be heated in a microwave oven, the container having at least one surface provided with a structure for generating within the container a microwave energy mode of a higher order than that of the container fundamental modes, wherein the mode generating structure has a periphery formed with a multiplicity of protuberances distributed around its perimeter for diffusing the heating effect of the higher order mode microwave energy.

25 Claims, 4 Drawing Sheets

CONTAINER FOR MICROWAVE HEATING INCLUDING MEANS FOR MODIFYING MICROWAVE HEATING DISTRIBUTION, AND METHOD OF USING SAME

BACKGROUND OF THE INVENTION

This present invention relates to cooking containers which can be used in microwave ovens, and to methods of using such containers. More particularly, the present invention relates to a container which provides improved microwave heating distributions when used in a microwave oven.

The invention will be particularly described with reference to the microwave cooking of foodstuffs, but it is to be understood that the invention in its broader aspect embraces the provision of containers (and methods of using them) for the microwave heating of bodies of any microwave-heatable material.

Applicant's copending U.S. patent applications Ser. No. 878,171, filed June 25, 1986, and entitled "Microwave Container and Method of Making Same," and Ser. No. 943,563, filed December 18, 1986, and entitled "Microwave Container with Dielectric Structure of Varying Properties and Method of Using Same," the disclosures of which are incorporated herein by this reference, describe containers for containing a material to be heated in a microwave oven. A container as therein described comprises an open topped tray for carrying the material and a lid covering the tray to form a closed cavity, and is characterized in that at least one surface of the container is formed with means for generating a mode of a higher order than that of the fundamental modes of the container, the mode generating means being so dimensioned and positioned with respect to the material when in the container that the mode so generated propagates into the material to thereby locally heat the material. As will be understood, in a container holding a food article being heated in a microwave oven, multiple reflections of radiation within the container or food article give rise to microwave field patterns which can be described as modes. It will also be understood that the term "generating" as used herein embraces both enhancement of modes already existing in the container and superimposition, on existing modes, of modes not otherwise existing in the container.

In a multi-compartment container, such as is used for heating several different foodstuffs simultaneously, the term "container" as used herein should be interpreted as meaning an individual compartment of that container. If, as is commonly the case, a single lid covers all compartments, then "lid" as used above means that portion of the lid which covers the compartment in question.

The container may be made primarily from metallic material, such as aluminum, or primarily from non-metallic material such as one of the various dielectric plastic or paperboard materials currently being used to fabricate microwave containers, or a combination of both.

In a conventional microwave oven, microwave energy, commonly at a frequency of 2.45 GHz, enters the oven cavity and sets up a standing wave pattern in the cavity, this pattern being at fundamental modes dictated by the size and shape of the walls of the oven cavity. In an ideal cavity, only fundamental modes exist, but in practice due to irregularities in the shape of the oven walls, higher order modes are also generated within the cavity and are superimposed on the fundamental modes.

Generally speaking, these higher order modes are very weak, and in order to promote better distribution of energy within the container, a "mode stirrer" can be used to deliberately generate or enhance the higher order modes.

If a container, such as a food container, is placed in the microwave oven, and microwave energy is caused to propagate into the interior of that container, then a similar situation exists within the container as exists within the oven itself: a standing wave pattern is set up within the container, this pattern being primarily in the fundamental modes of the container (as distinct from the fundamental modes of the larger oven cavity), but also containing modes higher than those of the fundamental modes of the container, which higher modes are, for example, generated by irregularities in the interior shape of the container and its contents. As before, these higher order modes are generally of much lower power than the fundamental modes and contribute little to the heating of the material within the container.

Attention will now be directed to the manner in which the material within the container is heated by the microwave energy existing within the container. In doing this, it is convenient to study only horizontal planes within the container. It is well known that the standing wave pattern within the container consists of a combined electric and magnetic field. However, the heating effect is obtained only from the electric field and it is therefore of significance to examine the power distribution of the electric field as it exists under steady-state conditions within the container. In the fundamental modes—which, it should be recalled, are those predominantly existing within the container—the pattern of power distribution in the horizontal plane is confined to the edge of the container and this translates into a heating effect which is likewise concentrated around the edge of the container. The material in the central part of the container receives the least energy and therefore, during heating, its center tends to be cool. In conventional containers, this problem of uneven heating is ameliorated by instructing the user to leave the material unattended for a few minutes after the normal microwave cooking time in order for normal thermal conduction within the food to redistribute the heat evenly. Alternatively, the material may be stirred, if it is of a type which is susceptible to such treatment.

The shape of these "cold" areas varies according to the shape of the container. For example, for a rectangular container the shape of the cold area in the horizontal plane is roughly rectangular; for a container which is circular in horizontal cross section, the cold area will be likewise circular and positioned at the center of the container. For an irregularly shaped container, such as is commonly found in compartments of a multi-compartment container, the "cold" area will roughly correspond to the outside contour of the container shape and will be disposed centrally in the container.

In considering the heating effect of higher modes which may or may not exist within the container, it is necessary to notionally subdivide the container into cells, the number and arrangement of these cells depending upon the particular higher order mode under consideration. Each of these cells behaves, from the point of view of microwave power distribution, as if it were itself a container and therefore exhibits a power distribution which is high around the edges of the cell, but low in the center. Because of the physically small size of these cells, heat exchange between adjacent cells during cooking is improved and more even heating of the material results. However, in the normal container, i.e. unmodified by the structures described in the aforementioned copending applications, these higher order modes are either not present at all or, if they are present, are not of sufficient strength to effectively heat the central regions of the food. Thus the primary heating effect is due to the fundamental modes of the container—i.e., a central cold area results.

Recognizing these problems, what the structures described in the aforementioned copending applications seek to do, in essence, is to heat this cold area by introducing heating energy into the cold area. This can be achieved in two ways:

(1) by redistributing the microwave field pattern within the container by enhancing higher order modes which naturally exist anyway within the container due to the boundary conditions set by the physical geometry of the container and its contents, but not at an energy level sufficient to have a substantial heating effect or, where such naturally higher order modes do not exist at all (due to the geometry of the container), to generate such natural modes.

(2) to superimpose or "force" onto the normal field pattern—which, as has been said, is primarily in the fundamental modes—a further higher order field pattern whose characteristics owe nothing to the geometry of the container and whose energy is directed towards the geoxetric center of the container in the horizontal plane which is the area where the heating needs to be enhanced.

In both the above cases, the net result is the same: the container can be notionally considered as having been split into several smaller areas each of which has a heating pattern similar to that of the fundamental modes, as described above. However, because the areas are now physically smaller, normal thermal convection currents within the food have sufficient time, during the relatively short microwave cooking period, to evenly redistribute the heat and thus avoid cold areas. In practice, under certain conditions higher order mode heating may take place due to both of the above mechanisms simultaneously.

The mode generating means described in the aforementioned copending application Ser. No. 878,171 may take one of two forms:

(1) Where said at least one surface of the container takes the form of a sheet of microwave-transparent material, a plate of electrically conductive material which is attached to or forms part of the sheet. Such a plate can be made for example of aluminum foil which is adhered to the sheet, or can be formed as a layer of metallization applied to the sheet.

(2) Where said at least one surface of the container takes the form of a sheet of electrically conductive material, such as aluminum foil, an aperture in the sheet through which microwave energy incident on the sheet can pass. Preferably, the aperture is covered by microwave-transparent material. In some instances, however, the aperture may simply be a void (i.e. open), for example to permit venting of steam from within the container.

It will be appreciated that the two alternatives listed above—i.e., the plate and the aperture—are analogues of one another. For ease of understanding, in the first alternative, the plate can be considered as a two-dimensional antenna, the characteristics of which follow from well-known antenna theory. Thus, the plate can be considered as receiving microwave energy from the oven cavity, whereupon a microwave field pattern is set up in the plate, the characteristics of which pattern are dictated by the size and shape of the plate. The plate then retransmits this energy into the interior of the container as a microwave field pattern. Because the dimensions of the plate are necessarily smaller than those of the container surface with which it is associated, the order of the mode so transmitted into the interior will be higher than the container fundamental modes.

In the second alternative, the aperture can be considered as a slot antenna, the characteristics of which again follow from theory. The slot antenna so formed effectively acts as a window for microwave energy from the oven cavity. The edges of the window define a particular set of boundary conditions which dictate the microwave field pattern which is formed at the aperture and transmitted into the interior of the container. Once again, because the dimensions of the aperture are smaller than those of the container surface with which it is associated, the shape and (particularly) the dimensions of the aperture are such as to generate a mode which is of a higher order than the container fundamental modes.

Several separate higher order mode generating means—be they plates or apertures--may be provided on each container to improve the heat distribution. The higher order mode generating means may all be provided on one surface of the container, or they may be distributed about the container on different surfaces. The exact configuration will depend upon the shape and normal (i.e., unmodified by the plates and/or apertures) heating characteristics, the object always being to get microwave energy into the cold areas, thus electrically subdividing the container down into physically smaller units which can more readily exchange heat by thermal conduction. The considerations which are to be given to the positioning of the higher order mode generating means will depend upon which of the two mechanisms of operation it is desired to use: if it is desired to enhance or generate a particular higher order mode which is natural to the container, then the above-mentioned cell pattern appropriate to that mode should be used to position the plates or apertures forming the higher order mode generating means. In order to enhance or generate a natural mode, a plate/aperture of approximately the same size as the cell will need to be placed over at least some of the cells—the larger the number of cells which have a plate or aperture associated with them, the better the particular mode chosen will be enhanced. In practice, a sufficient space must be left between individual plates/apertures in order to prevent field interaction between them—it is important that each plate/aperture is sufficiently far from its neighbor to be able to act independently. If the spacing is too close, the incident microwave field will simply see the plates/apertures as being continuous and, in these circumstances, the fundamental mode will predominate, which will give, once again, poor heat distribution. A typical minimum spacing between plates would be in the range of 6 to 12 mm, depending upon the particular container geometry and size. A typical minimum spacing between apertures (i.e. where the apertures are separated by regions of foil or other metallized layer) is in the range of 6 to 12 mm., both to protect the electrical integrity of the structure from mechanical damage such as scratches and to avoid ohmic overheating which is likely to result from high induced currents in narrower metal strips; a typical minimum with of metal border regions defining the outer peripheries of apertures would be in the same range, for the same reasons.

If, on the other hand, it is desired to use the mechanism of "forcing" an unnatural higher order mode into the container, then the plate/aperture forming the higher mode generating means needs to be placed over the cold area or areas within the container. In such circumstances, the plate/aperture, in effect, acts as a local heating means and does not (usually) significantly affect the natural modes of the container. Thus the "forced" mechanism utilizes the heating effect of the container fundamental superimposed onto its own heating effect. At certain critical sizes and positioning of the plates, both mechanisms—forced and natural—may come into play.

The aforementioned copending application Ser. No. 943,563 also describes the provision of a microwave heating container characterized in that at least one extended surface of the container is formed with means for modifying the microwave electric field pattern in the container by generating a mode of a higher order than that of the fundamental modes of the container, the modifying means being so dimensioned and positioned with respect to the material when in the container that the mode so generated propagates into the material thereby to locally heat the material. In the container of the latter copending application, however, the modifying means comprises at least a first dielectric wall portion of the container defining a first region of the extended surface and a second dielectric wall portion of the container defining a second region of the extended surface contiguously surrounding the first region, one of these two wall portions having an electrical thickness substantially greater than that of the other.

The latter copending application explains that useful field-modifying or mode generating effects can be achieved with a dielectric (i.e., electrically nonconducting) wall structure by providing appropriately arranged and configured adjacent or contiguous dielectric portions thereof that differ from each other in electrical thickness. For example, referring to those embodiments of structure described in the first-mentioned copending application (Ser. No. 878,171) wherein the extended surface is a sheet of microwave-transparent dielectric material having a conductive metal plate disposed thereon, comparable field-modifying effects are attainable (as set forth in copending application Ser. No. 943,563) by substituting for the metal plate a dielectric portion, in or on the sheet, having a greater electrical thickness than the surrounding portion of the sheet. Again, where in the copending application the higher order mode generating means is a metal sheet defining one or more apertures, in accordance with copending application Ser. No. 943,563 comparable effects are attainable by substituting for the metal sheet an "aperture"-defining dielectric wall portion of relatively high electrical thickness, with the "aperture(s)" constituted of dielectric wall portions of lower electrical thickness. The terms "plate" and "aperture" will be hereinafter sometimes broadly used to embrace the corresponding structures characterized by regions of differing electric thickness, as just described.

In each case, the dielectric wall structure of the invention serves (generally like the metal plate-dielectric sheet or metal aperture-defining sheet structures of the aforementioned copending application Ser. No. 878,171) to establish or generate, within the container, one or more modes of a higher order than the container fundamental mode, so as to achieve a beneficially modified heating distribution in the body of material being heated, as desired (for example) to provide enhanced uniformity of heating throughout the body, or to effect localized intensification of heating in or on selected portions of the body, as for browning or crispening.

The "electrical thickness" of a dielectric wall structure is a function of the actual spatial thickness of the wall (measured, in conventional units of length, between opposed surfaces thereof) and the dielectric constant of the wall material. Stated with reference to microwave energy of a given frequency, having a free-space wavelength $W_o$, and a wavelength $W_m$ in the dielectric wall material, for a wall having an actual spatial thickness d equal to $n_o$ times the wavelength $W_o$ (d being, of course, also equal to $n_m$ times the wavelength $W_m$, i.e., $d=n_oW_o=n_mW_m$) the electrical thickness D may be defined as that spatial distance equal to the number $n_m$ of free space wavelengths $W_o$, which number $n_m=d/W_m$. Consequently, $$D=n_mW_o=d\,(W_o/W_m)=d\,(k_m/k_o)^{\frac{1}{2}},$$

since $W_o/W_m$ is equal to the square root of the ratio of the dielectric constant $k_m$ of the wall material to the free space dielectric constant $k_o$. It will therefore be seen that the electrical thickness D of a dielectric wall portion increases with increasing spatial thickness d and/or increasing dielectric constant $k_m$ of the wall portion.

Preferably, in the structures of copending application Ser. No. 943,563, the dielectric wall portion(s) of greater electrical thickness are constituted of material having a higher dielectric constant than the material of the dielectric wall portion(s) of lesser electrical thickness. The portion(s) of greater electrical thickness may also have a greater spatial thickness than the portion(s) of lesser electrical thickness, although this is by no means necessary in all cases. The term "dielectric" herein is to be understood broadly as embracing conventional dielectric (nonconductive) materials and also so-called artificial dielectrics, such as dispersions of metallic particles in a nonconductive matrix, which are characterized by a dielectric constant significantly higher than that of the matrix material alone.

As a further particular feature of the containers of copending application Ser. No. 943,563, one or more of the aforementioned dielectric wall portions may be so constituted as to undergo a change in dielectric constant when subjected to irradiation by microwave energy. In this way, desired changes in heat distribution during the course of heating or cooking may be achieved.

For convenience of explanation, the present discussion considers matters only in the horizontal plane and for the same reason, the only surfaces which are formed with the higher order mode generating means in the embodiments which follow are horizontal surfaces—i.e., the bottom of the container or the lid of the container. However, there is no reason why the teachings of the aforementioned copending applications (and of the present invention) should not be applied to other than horizontal surfaces since the ambient microwave field in which the container is situated is substantially homogeneous.

Because the characteristics of the plate/aperture alternatives are analogous (indeed a particular aperture will transmit an identical mode to that transmitted by a plate of identical size and shape), it is possible to use them interchangeably—in other words, whether a plate or aperture of particular dimensions is used, can be dictated by considerations other than that of generating a particular microwave field pattern.

Clearly, the heating effect of the higher order mode generating means will be greatest in the food immediately adjacent to it and will decrease in the vertical direction. Thus, it may be an advantage to provide higher mode generating means both in the lid and in the bottom of the container. Since the cold areas will be in the same position in the horizontal plane whether the lid or the bottom of the container is being considered, it is clearly convenient to make the higher mode generating means in the lid in registry with those in the bottom of the container. By this means, better heat distribution in the vertical direction can be achieved. It matters not which particular type of higher mode generating means is used as between the lid and the bottom—in one embodiment, for example, a plate or plates are formed on the lid, while in-registry aperture or apertures are formed in the container bottom. In another embodiment, apertures are provided in both lid and bottom surfaces.

Higher-mode generating means such as plates or apertures with peripheries generally conforming to the shape of the container with which they are used (e.g. generally rectangular, in the case of a rectangular container, or circular, in the case of a circular container) have been found highly effective in particular instances in achieving excitation or enhancement of desired higher modes. It has been found, however, that microwave ovens differ significantly from each other in the extent to which these higher modes are generated or enhanced when such mode generating means are employed. Thus, the mode generating means that functions satisfactorily in one oven may produce pronounced local overheating or undercooking in another oven which "feeds" the generated higher mode with greater or less efficiency.

This difficulty has been encountered, for example, in the case of microwave containers of circular horizontal cross section, e.g. containers for pot pies, when the mode-generating means comprises or includes a circular metal foil plate centered on the surface of a microwave-transparent lid of the container or a foil ring mounted on the lid surface in concentric relation to the container periphery. In some ovens, these structures are very satisfactory in obtaining the desired result, viz. that the upper pastry crust be uniformly cooked and browned and that the underlying fill reach uniform temperatures. In other ovens, however, use of the same mode generating means causes either undercooking or overcooking of the central regions of the pie crusts and/or fillings. When simple foil discs or rings are configured to eliminate undercooking of these central regions for some ovens, pronounced overcooking occurs in other ovens; and conversely, discs or rings configured to reduce central region overcooking in these latter ovens cause aggravated undercooking in other ovens. It has thus been difficult to achieve consistently satisfactory heating, with any particular mode generating means, over a wide range of different ovens.

SUMMARY OF THE INVENTION

The present invention, in a first aspect, broadly contemplates the provision of a package of material to be heated in a microwave oven, comprising a container and a body of the material, the body being disposed in the container. The container (like those of the aforementioned copending applications) comprises an open topped tray for carrying the body of material and a lid covering the tray to form a closed cavity, the container and body defining fundamental modes of microwave energy in the cavity; and at least one surface of the container is formed with mode generating means for generating, within the cavity, at least one microwave energy mode of a higher order than that of the fundamental modes, this mode generating means being dimensioned and positioned with respect to the body of material in the container for causing microwave energy in at least that one higher-order mode to propagate into the body of material to thereby locally heat the body of material. In such a container, the invention contemplates the provision of mode generating means characterized by a configuration which is nonconformal to the periphery of the container.

More particularly, in accordance with the present invention, in important embodiments thereof, the mode generating means has a periphery (e.g., plate or aperture edge) which, as projected on the aforementioned container surface, is a closed figure enclosing an area of that surface and formed with a multiplicity of (i.e., more than two) protuberances distributed around its perimeter; the aforementioned nonconformality of configuration of the mode generating means, in such case, comprises the protuberances. In specific embodiments of the invention, the number, spacing and amplitude of the protuberances are such as to diffuse the heating effect of the higher-order-mode microwave energy propagating into the body of material.

It is to be understood that the periphery of the mode generating means in the packages of these embodiments of the invention is itself formed with a multiplicity of protuberances. The definition of the mode generating means periphery, with reference to the figure projected on the surface on or at which such means is formed, is intended to express the orientation of the protuberances of the periphery relative to that surface. In currently preferred embodiments of the invention, the mode generating means is a flat metal (e.g. foil) plate bonded to a surface of the container, and its peripheral protuberances are thus essentially coincident with the projected figure. In a broader sense, however, the invention embraces the provision of mode generating means of any of the types described in the aforementioned copending applications, and includes mode generating means which may project above or below and/or be spaced from the surface.

Stated with reference to a container which is substantially circular as viewed in plan projection, and wherein the surface formed with the mode generating means is a top or bottom surface of the container, it is currently preferred that the mode generating means have a periphery, with the aforementioned protuberances, so configured that the projected figure is a substantially radially symmetric figure having a center substantially coincident with the center of the container as viewed in plan projection. Preferably in many instances, the protuberances are radially disposed, in the sense that their respective geometric axes are generally convergent toward a central locality of the closed figure. In such a container, it is also currently preferred that the lid be formed of dielectric material substantially transmissive to microwave energy and that the mode generating means be an electrically conductive plate disposed in or on the lid, with its periphery spaced inwardly from the periphery of the lid.

In one specific form of mode-generating means for such containers, the projected figure (i.e., the periphery of the mode generating plate) is an epitrochoid, preferably having a number of protuberances between five and seven. Again, the periphery of the mode-generating plate may be a figure generated by the rotation of the first point about a second point which is itself rotated about the center of the container as viewed in plan projection, with the radius of rotation of the first point being greater than that of the second point and with the two points respectively rotating at different rates. In an alternative embodiment, the periphery of the mode-generating plate is a figure formed by the exterior portions of multiplicity of overlapping circles of equal radius having their centers respectively disposed at the vertices of an equilateral polygon. In a still further arrangement, the protuberances may be configured as spiral arms.

To avoid problems of localized overheating in particular instances, it is strongly preferred that the protuberances have rounded extremities rather than pointed tips. The reentrants between adjacent protuberances may, however, be either rounded or pointed.

The microwave packages of the invention, with mode generating means having the described protuberances, are found to afford highly satisfactorily uniform heating of the package contents, including the central regions thereof, in a wide variety of different ovens, as to which mode generating means lacking such protuberances would produce undesirable variations in heating, such as undercooking in some ovens and overcooking of the central region of the contents in other ovens. That is to say, the protuberances formed on the mode generating means appear to diffuse the heating effect of the higher order mode or modes generated or enhanced by such means, in a way that compensates for the variation between different ovens in respect of excitation of the higher order mode or modes. The exact mechanism by which this diffusion effect is produced may not be fully understood, and indeed different or plural mechanisms may be involved with different ones of the specific embodiments described above. Stated in general, the effectiveness of the protuberances in achieving such diffusion of heating is dependent on the number, spacing and amplitude of the protuberances. Thus, it is important that the number of protuberances be sufficiently small and that their spacing and amplitude be sufficiently large so that that they will be "seen" by the incident microwave energy. It is also important that the protuberances not coincide in number and position with the lobes of the electric field pattern of the fundamental modes of the container and contents since in the latter case the protuberances would tend to enhance the coupling of microwave energy into those fundamental modes rather than achieving the desired higher order mode heating in the central region.

The invention in a second aspect contemplates the provision of a container (for material to be heated in a microwave oven) having mode generating means with the aforementioned nonconformal configuration (e.g., formed with these protuberances). In yet a further aspect, the invention contemplates the provision of a method of heating a body of material in a microwave oven, including placing the body in a container having mode generating means of the such nonconformal configuration (e.g., formed with these protuberances), disposing the container in a microwave oven, and energizing the oven to irradiate the container and oven with microwave energy.

Further features and advantages of the invention will be apparent from the detailed description hereinbelow set forth, together with the accompanying drawings.

DETAILED DESCRIPTION

Figure 1:
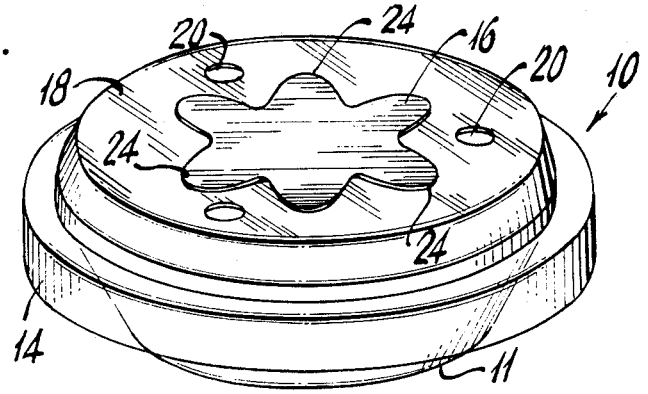
FIG. 1 is a perspective view of a package for microwave heating of a body of material embodying the present invention in a particular form.
Figure 2:
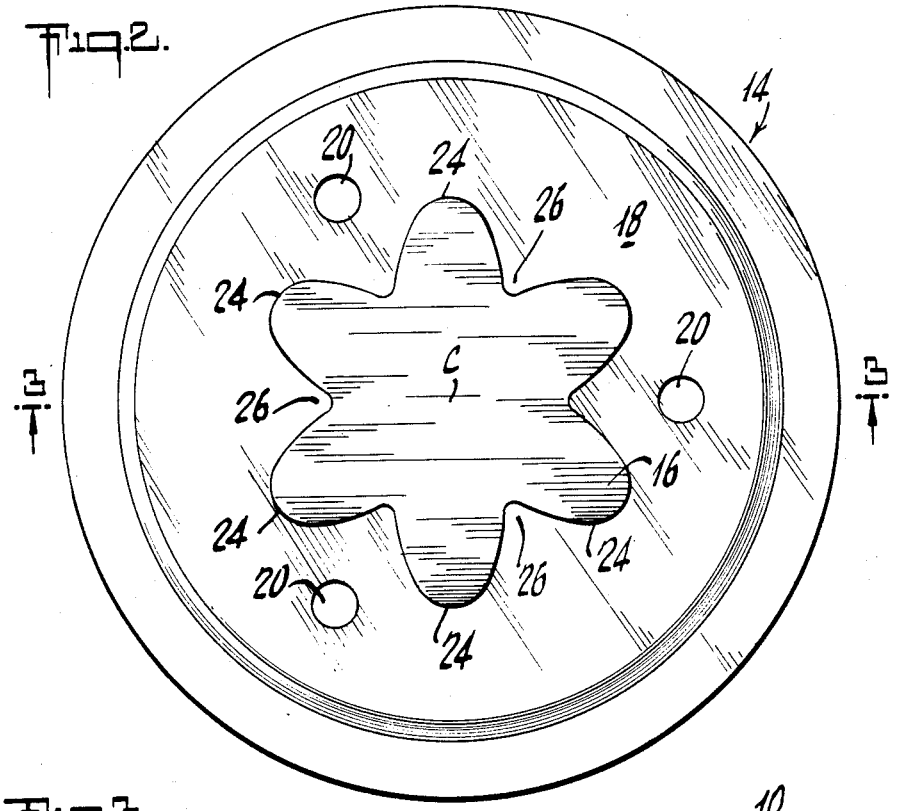
FIG. 2 is an enlarged plan view of the top or lid of the container of FIG. 1, including the mode generating means disposed thereon.
Figure 3:
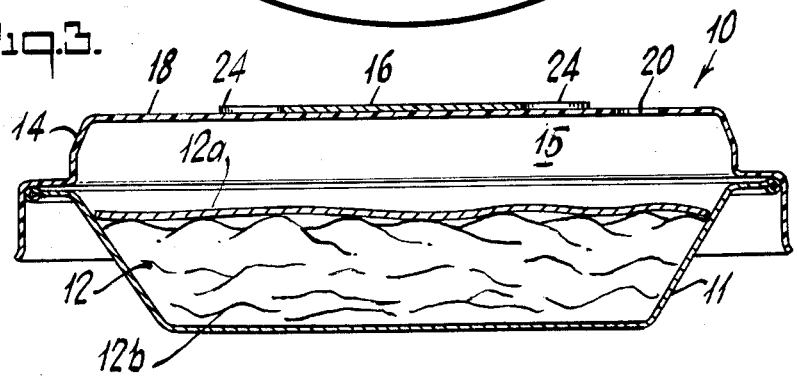
FIG. 3 is a sectional elevational view of the package of FIG. 1, taken as along the line 3—3 of FIG. 2.

Referring first to FIGS. 1–12, for purposes of illustration the invention will be described as embodied in or employing a microwave container 10 (i.e., a container for holding a body of foodstuff, such as a pot pie, for heating in a microwave oven) which is circular in horizontal cross-section and which includes an open topped aluminum foil tray 11 in which a pot pie 12 is disposed, a molded plastic lid 14 covering the tray to form a closed cavity 15, and a higher-order-mode generating means provided in the form of an electrically conductive aluminum foil plate 16 mounted on the upwardly-facing major surface 18 of the lid 14. The lid is fabricated of a dielectric material, transmissive to microwave energy. The pie, as shown in FIG. 3, is constituted of a top crust **12*a* (which may itself be pierced with small holes, not shown, for venting) and filler material 12*b***.

As shown in FIGS. 1–3, the lid upper surface 18 is flat, circular, horizontal and concentric with the lateral periphery of the tray 11, and has several openings 20 for venting the interior of the container when the pie is being heated; the foil plate 16 lies flat on the lid surface 18, being suitably adhered or bonded thereto, and is centered thereon so as to cover a central area of the lid but is substantially smaller than the lid surface, the foil periphery or outer edge being spaced inwardly from the lateral periphery of the container entirely around the circumference of the container. Consequently, the peripheral region of the lid surface, overlying the peripheral region of the contained pot pie, is not covered by the foil.

As thus far described, the container 10 with its mode generating plate 16 is generally similar to embodiments of the microwave containers described in the aforementioned copending application Ser. No. 878,171, utilizing a metal foil or like metallic plate or metallized region mounted on the container lid as a means for generating one or more higher modes of microwave energy within the container cavity. Specifically, the present container corresponds in these respects to an embodiment of the structures of the last-mentioned copending application wherein a circular mode-generating metal plate is centrally disposed on the lid of a container of circular horizontal cross-section to generate or enhance a higher order mode that will produce heating of a central region (as viewed in a horizontal plane) of the contained body of foodstuff. In this regard, reference may be made to FIGS. 11 and 12, which illustrate in a very simplified way the electric field patterns (viewed in a horizontal plane) of the fundamental modes of the container 10 and contents 12 in two different microwave ovens, these patterns being represented as lobes 22*a* (FIG. 11) and 22*b* (FIG. 12) distributed around and adjacent the container periphery; suchfield patterns, unmodified, would produce heating of the lateral peripheral region of the pie while leaving the central region relatively cold, but the provision of an appropriately dimensioned circular conductive mode generating plate centered on the container lid or bottom surface will excite or enhance a higher order mode of microwave energy propagation in the container cavity, closer to the center of the pie, to achieve heating of the central region.

For a given container diameter D (measured in a horizontal plane), central region heating will be optimized by use of a circular mode generating plate of radius $R_o$. The latter radius is substantially smaller than D/2, but sufficiently large so that the attenuation of the higher-order mode it generates is not so abrupt as to prevent effective heating of the pie. In some microwave ovens, use of a centered foil disc or plate of this radius will produce the desired result of substantially uniform heating, but in other ovens (owing to the difference between ovens in respect of their interaction with such mode generating means) excessive heating will occur in the central region.

As a particular feature of the present invention, in the embodiment of FIGS. 1–3, to overcome this problem and thereby to enable effective use of the same container in a wide variety of different ovens, the mode generating plate 16 of FIGS. 1–3 has a periphery which (instead of being circular) is formed with a multiplicity of protuberances 24 regularly distributed around its circumference, the open or cut-out areas between adjacent protuberances being herein designated reentrants 26. In the embodiment of FIGS. 1–3, there are six such protuberences 24, so disposed and dimensioned that the periphery of the plate 16 is radially symmetrical about the center C of the container 10 as viewed in a horizontal plane. The plate in this embodiment is effectively two-dimensional, lying flat against the lid surface 17, so that the projection of the plate periphery on surface 17 is a closed figure, enclosing a central area of the lid surface, having the protuberences 24 and essentially coincident with the plate periphery.

Figure 4:
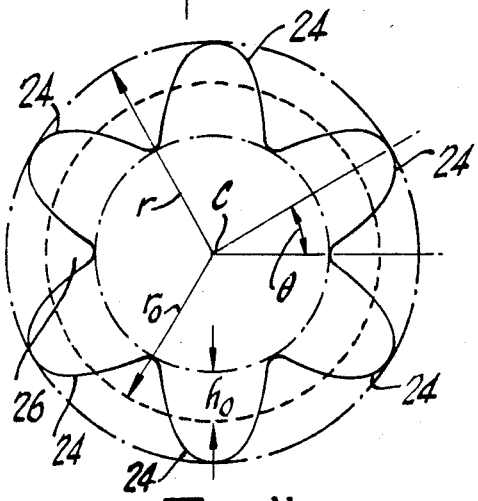
FIG. 4 is a diagram showing the mode generating means of the FIG. 1 container in plan view, to illustrate the geometric considerations governing its configuration.

More particularly, as may be explained with reference to FIG. 4, the periphery of the plate 16 is an epitrochoid, the shape of which is defined by the equation $$r=r_o+h_o\cos n\theta \tag{1}$$

where r, $r_o$, $h_o$, and $\theta$ have the significance indicated in FIG. 4 and n is the number of protuberances. In this case, $h_o$ is the amplitude of the protuberances. It is currently preferred, for a container of horizontal diameter D, that $r_o=R_o$ as designed above; in such case, the total surface area of the plate 16 is not greatly different from that of a circular plate of radius $R_o$.

Figure 5:
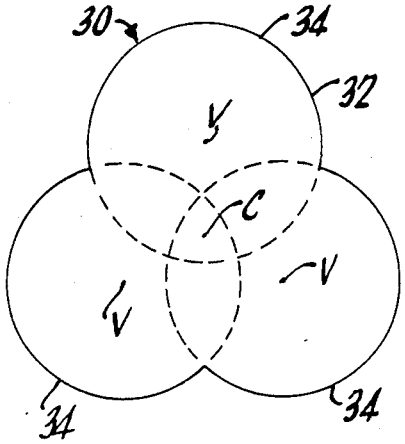
FIG. 5 is a plan view of another embodiment of mode generating means in accordance with the invention, suitable for use with the container of FIG. 1.
Figure 11:
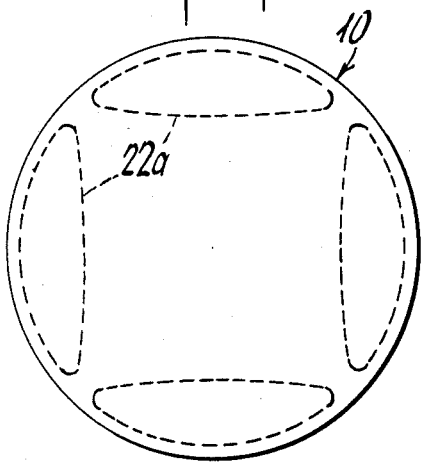
FIGS. 11 and 12 are simplified diagrammatic plan views of the container of FIG. 1, to illustrate fundamental-mode electric field patterns generated in such containers in microwave ovens.
Figure 12:
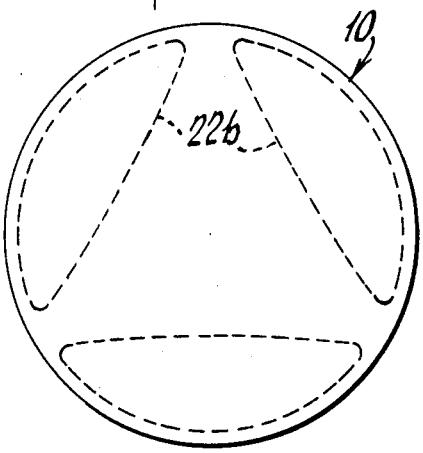

The epitrochoid of FIGS. 1–4 is but one example, albeit currently preferred, of mode generating plate configurations having a multiplicity of peripheral protuberances in accordance with the present invention. Another example, illustrated in FIG. 5, is a metal foil plate 30 having a periphery (solid line 32) formed with multiple protrusions 34, the configuration of which is defined by a multiplicity of overlapping circles of identical radius having their centers respectively disposed at the vertices V of an equilateral polygon; as shown, the plate periphery is constituted of the exterior (non-overlapping) portions of these circles, and is radially symmetrical. Such plates, defined by figures wherein the number of vertices V is 3, 4 or 5, have been found effective to achieve the advantages of the invention when used on a container as shown in FIGS. 1–3, i.e., in place of the plate 16, with the center of the plate 30 disposed at the center C of the container as viewed in a horizontal plane.

Figure 6:
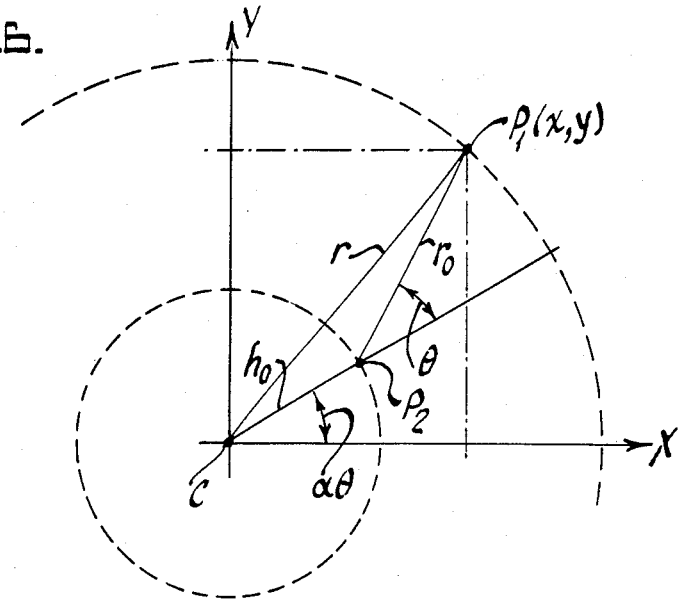
FIG. 6 is a diagram in explanation of the generation of the peripheral shape of still other mode generating means suitable for use in the package of FIG. 1.
Figure 7:
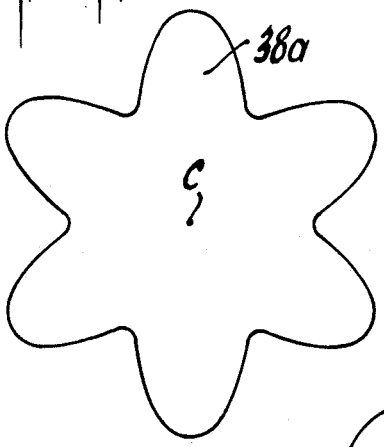
FIGS. 7, 8 and 9 are plan views of three different configurations that may be generated in the manner described with reference to FIG. 6.
Figure 8:
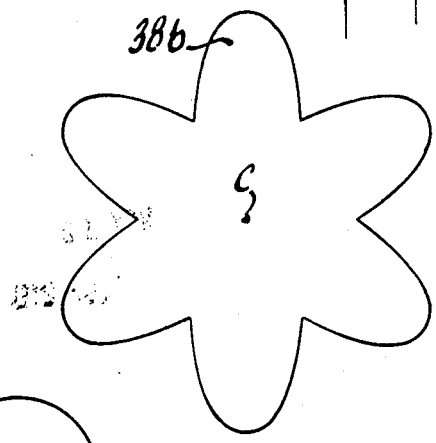
Figure 9:
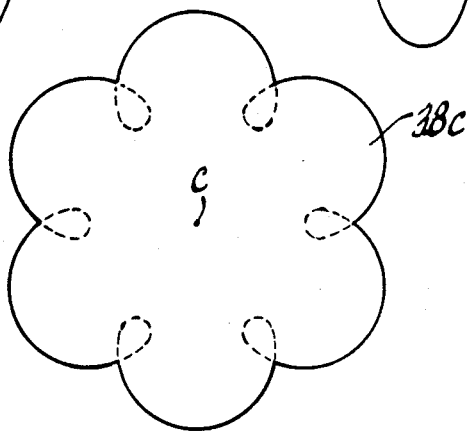

Still further plate periphery configurations in accordance with the invention may be generated in the manner illustrated in FIG. 6, by rotation of a first point $P_1$ about an origin or second point $P_2$ which is itself rotated about a "true" origin here identified as the center C of the container as viewed in a horizontal plane, with the radius $r_o$ of rotation of $P_1$ about $P_2$ being greater than the radius $h_o$ of rotation of $P_2$ about C and with the two points respectively rotating at different rates. In these "rotating origin" embodiments, the defining equations for the x and y coordinates of $P_1$ in a Cartesian coordinate system (with C as the true origin), and of the distance r of $P_{1(x,y)}$ from C, are given by the following equations:

$$x=h_o\cos\alpha\theta+r_o\cos(\alpha+1)\theta \tag{2}$$

$$y=h_o\sin\alpha\theta+r_o\sin(\alpha+1)\theta \tag{3}$$

$$r=[r_o^2+h_o^2+2r_oh_o\cos\theta]^{\frac{1}{2}} \tag{4}$$

wherein $r_o$, $h_o$, r, $\alpha\theta$, and $\theta$have the significance indicated in FIG. 6. Illustrative mode generating plate periphery configurations in accordance with the invention that may be generated in this "rotating origin" manner, depending on the selection of parameters, are shown in FIGS. 7, 8 and 9; each of these plates (respectively designated 38*a*, 38*b*, and 38*c*), if fabricated (for example) of aluminum foil, may be used in place of the plate 16 in the container of FIGS. 1–3, being likewise centered on the lid surface 17 and being radially symmetrical about the container center C. In FIG. 9, it may be noted, only the solid line represents the plate periphery, the broken line portions merely serving to complete the illustration of the generated figure. As will be appreciated, at low amplitude the figure generated by the "rotating origin" procedure approximates an epitrochoid.

Figure 10:
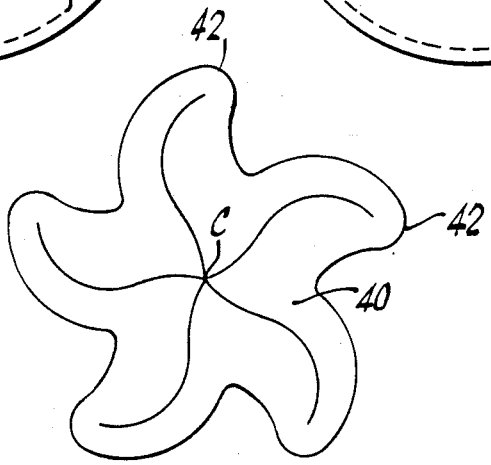
FIG. 10 is a plan view of yet another form of mode generating means in accordance with the invention, suitable for use in the package of FIG. 1.

Yet another illustrative embodiment of a conductive mode generating plate having protuberances in accordance with the invention is shown at 40 in FIG. 10. In this plate, the protuberances 42 are spiral arms radiating symmetrically from a common center which is coincident with the container center C when the plate 40 is used in place of the plate 16 in the container of FIGS. 1–3.

Referring further to a container of the type shown at 10 in FIGS. 1–3, it will be understood that the various plate configurations illustrated in FIGS. 4, 5, and 7–10 are intended to replace an aluminum foil or like electrically conductive mode generating plate having the shape of a circular disc (e.g., with radius $R_o$, as defined above) mounted on the lid upper surface 18, and centered thereon, for higher mode generation of such nature as to heat the central region of the contained body of material represented by pie 12. Thus, the plates having peripheral protuberances may be considered as corresponding to such a disc, wherein the periphery of the disc has been modified from a simple circle to a form having alternating protuberances and reentrants. The specific configurations shown and described above, as will be understood, are merely exemplary, and the invention broadly embraces the use of mode generating means having arrangements of protuberances other than the specific forms herein shown and described. Also, of course, while detailed reference has been made herein to circular containers and to the use of mode generating means of the conductive plate type, the invention may be embodied in structures having any of the various other types of mode generating means described in the aforementioned copending applications, wherein the periphery of the mode generating means (whether the edge of a plate, or the edge of an aperture) has the described multiple protuberances distributed around its periphery; and the detailed description of protuberance configuration, distribution and amplitude herein set forth is to be understood as being broadly applicable to such other embodiments and to containers of other shapes (elliptical, rectangular, etc.) as well.

It is found that by forming the periphery of a mode generating structure with distributed protuberances and intervening reentrants, as exemplified by the plates 16, 30, **38*a*, 38*b*, 38*c* and 40 described above, the plate or other mode generating structure will provide consistent and uniform heating of the container contents, including the central region, in a wide range of different ovens, without localized overheating and at the same time without loss of effectiveness of the mode generating means in exciting or enhancing higher order modes to modify as desired the pattern of heating in the body of material within the container. Achievement of these objectives is dependent on the amplitude, spacing and number of the protuberances. If the protuberances are of small size (departing only slightly from a circular periphery, in a mode generating disc for use in the container of FIGS. 1–3**), they will have little effect in avoiding the central-region overheating problems which would otherwise be encountered with use of a disc-shaped mode generating means in particular ovens. Similarly, if the protuberances are very numerous and close together, the incident microwave energy will not "see" them, and they will act more or less as a uniform disc. However, if the protuberances are of sufficiently large amplitude, with sufficiently large spacing between them, they provide the desired effect of diffusing the heating resulting from higher mode excitation so as to enable attainment of satisfactory results with a wide variety of ovens. On the other hand, excessive amplitude of protuberances can result in undercooking of the central region and overcooking near the periphery of the contained pie or other foodstuff.

In particular, in the epitrochoidal and "rotating origin" structures exemplified by FIGS. 4 and 7–9, a currently preferred number of protuberances (in a radially symmetric plate) is between 5 and 7. A smaller number of protuberances (three or four) is desirably avoided, in view of the three- and four-lobed arrangements of the fundamental mode electric field patterns shown in FIGS. 11 and 12, because a plate having a number of protuberances equal to the number of such lobes may tend to couple microwave energy into the fundamental mode rather than to generate the desired higher order mode or modes for heating the central region of the body of material in the container. When the number of protuberances exceeds seven, their amplitude is so small and/or the spacing between them so reduced as to diminish their effectiveness in diffusing the heating pattern attributable to higher order mode generation.

By way of specific example, in a container as shown in FIGS. 1–3, having a horizontal diameter of 5 inches (12.70 cm), the optimum value $R_o$ for a centered circular mode generating plate is 2.75 cm. That is to say, a disc of this radius most effectively couples higher mode microwave energy into the central region of a body of foodstuff in a container of such diameter. Referring to equation (1) above, a currently preferred epitrochoidal plate 16 to replace the circular disc has six protuberances 24 (i.e., $n=6$), and the following dimensions: $r_o=2.75$ cm; $h_o=0.75$ cm (although good results are still obtained with somewhat smaller values of $h_o$, e.g. 0.7 cm, or even 0.65 cm).

The theoretical explanation for the effectiveness of the protuberances in diffusing heat resulting from higher order mode generation, in the case of the plate configurations exemplified by FIG. 5, is believed attributable to the replacement of a single disc having a single center or focus with a multiplicity (three or more) of spaced, less distinct foci V. That is to say, since the intense, central-region heating observed in some ovens with simple mode generating discs may be due to the existence of a single origin or focus, the proliferation and spacing of foci may produce the desired diffusion of heating.

In the epitrochoidal and "rotating origin" structures, it is believed that the diffusion of heating may result from some effect of the plate with its protuberances as a static mode stirrer. These configurations can be viewed as generated by rotation of the origin of a cylindrical coordinate system. The lobes resulting from this rotation may be expected to favor corresponding angular modes in the body of material being heated, while rotation of the origin would be expected to give the desired diffuse heating in the central region of the body; the favoring of particular angular modes may also serve to suppress undesired angular heating patterns in the body.

More generally, the peripheral configurations of the mode generating means provided in accordance with the invention are at present believed to provide more diffuse heating through perturbation of a simple mode structure, and as a result of the complexity of the propagation path dictated by the peripheral configuration of the mode generating means.

Very desirably, the protuberances in the plates described above are rounded at their extremities rather than pointed, to avoid the possibility of generating very strong fields at pointed extremities, with resultant arcing and/or softening of the plastic lid at those localities. The reentrants between adjacent protuberances, however, may be either rounded or pointed.

In the use of a container having mode generating means in accordance with the invention, the body of food or other material to be heated is first disposed in the container, the container is then placed in a microwave oven, and the oven is operated to irradiate the container and the body with microwave energy, thereby heating the body with desired uniformity as achieved through higher mode excitation yet without localized overheating.

Figure 13:
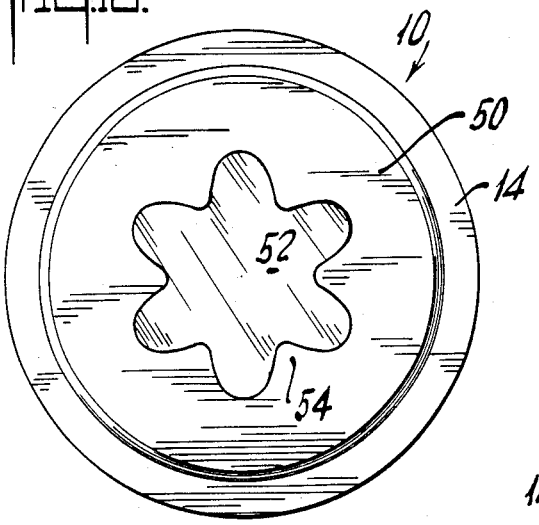
FIG. 13 is a schematic plan view of another embodiment of the microwave container of the invention.
Figure 14:
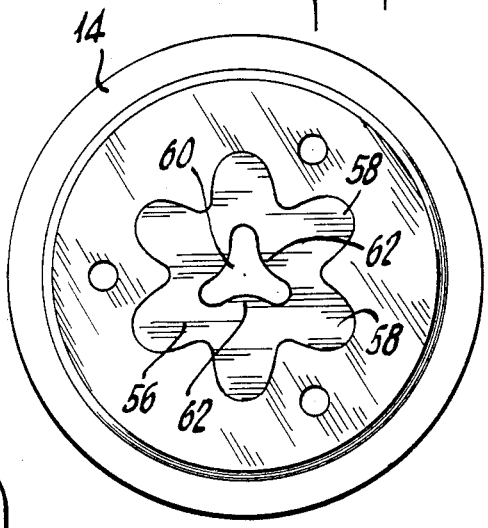
FIG. 14 is a similar view of yet another embodiment.
Figure 15:
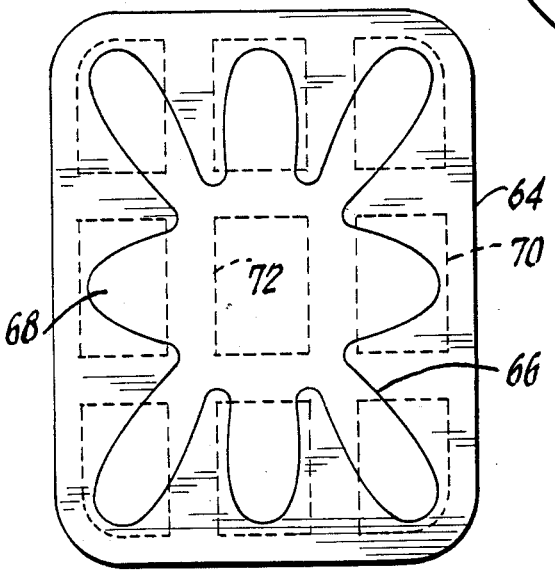
FIG. 15 is a similar view of a still further embodiment.

FIGS. 13–15 illustrate, in plan view, several further embodiments of the invention. In FIG. 13, the mode generating plate of the embodiments described above is replaced (in the container 10) with a mode generating structure comprising an aluminum foil disc 50 extending over the entire top surface of the container lid 14 and having a central aperture 52, the periphery of which is formed with a plurality of protuberances 54. In FIG. 14, the mode generating plate on the lid 14 (in the container 10) is replaced with an annular aluminum foil plate 56, again mounted centrally on the top surface of the lid 14 and having an outer periphery formed with a first plaurality of protuberances 58 and a central aperture 60, the edges of which are formed with a second plurality of protuberances 62. In the case of protuberances projecting inwardly from the periphery of a mode generating aperture structure, such as the protuberances shown at 54 in FIG. 13 and at 62 in FIG. 14, it is necessary that their inner extremities be sufficiently rounded, and that their separation be such, as to prevent arcing or the development of fields intense enough to cause undesired heating of the structures. As the embodiment of FIG. 14 represents, where the mode generating structure includes both the outer periphery of a plate and an aperture defined by the plate, the inner and outer protuberances need not be aligned in an angular or other sense, and their number need not be identical.

FIG. 15 illustrates in plan view the lid 64 of a generally rectangular container, this lid being fabricated of an essentially microwave-transparent plastic. On this lid there is disposed an aluminum foil plate 66 having its perimeter formed with a multiplicity of protuberances 68 respectively extending to and overlying the areas indicated by broken lines 70. The broken lines 70 represent an arrangement of rectangular plates (e.g. metal foil plates) that, if mounted on the lid 64, would collectively constitute a higher order mode generating means for accentuating a [3, 3]resonance. The central portion of the plate 66 overlies the central area of the lid 64, which (if the plates represented by broken lines 70 were used) would bear a central plate 72.

In this embodiment again, the protuberances 68 are sufficiently rounded to avoid the development of excessive field intensities. The length to which they extend from the central region determines the balance between heating in the central and peripheral regions of the body of foodstuff or other material within the illustrated rectangular container. An advantage of the embodiment of FIG. 15 over a container structure employing the multiple separate foil plates 70, 72 is that only a single foil plate (rather than nine) is cut and mounted on the container lid, thereby reducing the complexity (and potentially the cost) of the manufacturing operation. The provision of a different number of protuberances might be used to suppress one or another mode, and in this eventuality, the protuberances need not be aligned with the container geometry. That is to say, in this embodiment, depending on the arrangement, number and shape of the protuberances, the protuberances may be used to accentuate a choice of modes or alternatively to suppress them, as well as (by appropriate selection of the length to which they extend from the central region) to obtain a desired diffuseness or evenness of heating or to achieve a desired balancing of heating between the central and peripheral regions of the container.

It is to be understood that the invention is not limited to the features and embodiments hereinabove specifically set forth but may be carried out in other ways without departure from its spirit.

I claim:

1. A package of material to be heated in a microwave oven, comprising a container and a body of material to be heated isposed in said container, said container comprising an open topped try carrying said body of material and a lid covering said tray to form a cavity, said container and said body defining fundamental modes of microwave energy in said cavity, and at least one surface of the container being provided with mode geneating means for generating, within the cavity, at least one microwave energy mode of a higher orer than that of said fundamental modes, said mode generating means being dimesioned and positioned with respect to the body of material in the container for causing microwave energy in said at least one higher-order mode to propagate into the body of material to thereby locally heat the body of material, wherein the improvement comprises:

said mode generating means having a periphery which, as projected on said at least one surface, is a closed figure enclosing an area of said at least one surface and formed with a multiplicity of protuberances distributed aroun its perimeter, the number, spacing and amplitude of said protuberances being such as to diffuse the heating effect of said higher-order-mode microwave energy propagating into said body of material.

2. A package as defined in claim 1, wherein said container is substantially circular as viewed in plan projection, wherein said at least one surface is a top or bottom surface of said container, and wherein said figure is a substantially radially symmetrical figure having a center substantially coincident with the center of said container as viewed in plan projection, said protuberances extending generally radially of said figure.

3. A package as defined in claim 2, wherein said lid is formed of dielectric material substantially transmissive to microwave energy and wherein said mode generating means is an electrically conductive plate disposed in or on said lid, the periphery of said plate being spaced inwardly from the periphery of said lid.

4. A package as defined in claim 3, wherein said figure is an epitrochoid.

5. A package as defined in claim 4, wherein the number of said protuberances is five, six or seven.

6. A package as defined in claim 5, wherein the number of said protuberances is six.

7. A package as defined in claim 3, wherein said figure is formed by the exterior portions of a multiplicity of overlapping circles of equal radius having their centers respectively disposed at the vertices of an equilateral polygon.

8. A package as defined in claim 7, wherein the numbe of said vertices is not more than five.

9. A package as defined in claim 3, wherein said figure is generated by the rotation of a first point $P_1$ about a second point $P_2$ itself rotating about the center of said container as viewed in plan projection.

10. A package as defined in claim 9, wherein the radius of rotation of $P_1$ is greater than of $P_2$, the rate of rotation of $P_1$ about $P_2$ differs from the rate of rotation of $P_2$ about said center, and the number of said protrusions is between five and seven.

11. A package as defined in claim 3, wherein said protuberances are spiral arms.

12. A package as defined in claim 1, wherein said mode generating means is an electrically conductive plate defining an aperture having a closed periphery and wherein said protuberances project inwardly from the edge of said periphery.

13. A package as defined in claim 12, wherein said plate has a closed outer periphery spaced inwardly from the periphery of said container, and wherein said outer periphery is formed with a plurality of outwardly projecting protuberances.

14. A package as defined in claim 1, wherein the periphery of said container is substantially rectangular in a horizontal plane and wherein said mode generating means is an electrically conductive plate disposed centrally with respect to the container periphery and having a multiplicity of protuberances projecting outwardly from its perimeter.

15. A package as defined in claim 1, wherein said protuberances have rounded extremities.

16. A container for holding a package of material to be heated in a microwave oven, comprising an open topped tray for carrying said body of material and a lid covering said tray to form a cavity, said container defining fundamental modes of microwave energy in said cavity, and at least one surface of the container being provided with mode generating means for generating, within the cavity, at least one microwave energy mode of a higher order than that of said fundamental modes, said mode generating means being dimensioned and positioned with respect to the body of material when in the container for causing microwave energy in said at least one higher-order mode to propagate into the body of material to thereby locally heat the body of material, wherein the improvement comprises:

said mode generating means having a periphery which, as projected on said at least one surface, is a closed figure enclosing an area of said at least one surface and formed with a multiplicity of protuberances distributed around its perimeter, the number, spacing and amplitude of said protuberances being such as to diffuse the heating effect of said higher-order-mode microwave energy propagating into said body of material.

17. A container as defined in claim 16, which is substantially circular as viewed in plan projection, wherein said at least one surface is a top or bottom surface of said container, and wherein said figure is a substantially radially symmetrical figure having a center substantially coincident with the center of said container as viewed in plan projection.

18. A container as defined in claim 17, wherein said lid is formed of dielectric material substantially transmissive to microwave energy and wherein said mode generating means is an electrically conductive plate disposed in or on said lid, the periphery of said plate being spaced inwardly from the periphery of said lid.

19. A container as defined in claim 18, wherein said figure is an epitrochoid.

20. A package as defined in claim 18, wherein said figure is formed by the exterior portions of a multiplicity of overlapping circles of equal radius having their centers respectively disposed at the vertices of an equilateral polygon.

21. A container as defined in claim 18, wherein said figure is generated by the rotation of a first point $P_1$ about a second point $P_2$ itself rotating about the center of said container as viewed in plan projection.

22. A container as defined in claim 18, wherein said protuberances have rounded extremities.

23. A container as defined in claim 18, wherein said protuberances are spiral arms.

24. A method of heating a body of material in a microwave oven, comprising:

placing said body of material in a container comprising an open topped tray carrying said body of material and a lid covering said tray to form a cavity, said container and said body defining fundamental modes of microwave energy in said cavity, and at least one surface of the container being provided with mode generating means for generating, within the cavity, at least one microwave energy mode of a higher order than that of said fundamental modes, said mode generating means being dimensioned and positioned with respect to the body of material in the container for causing microwave energy in said at least one higher-order mode to propagate into the body of material to thereby locally heat the body of material, said mode generating means having a periphery which, as projected on said at least one surface, is a closed figure enclosing an area of said at least one surface and formed with a multiplicity of protuberances distributed around its perimeter, the number, spacing and amplitude of said protuberances being such as to diffuse the heating effect of said higher-order-mode microwave energy propagating into said body of material;

disposing the container and body in a microwave oven; and irradiating the container and body with microwave energy in the oven.

25. A method as defined in claim 24, wherein said container is substantially circular as viewed in plan projection, said at least one surface is a top or bottom surface of said container, said figure is a substantially radially symmetrical figure having a center substantially coincident with the center of said container as viewed in plan projection, said lid is formed of dielectric material substantially transmissive to microwave energy, and said mode generating means is an electrically conductive plate disposed in or on said lid, the periphery of said plate being spaced inwardly from the periphery of said lid.

* * * * *